United States Patent [19]

Heikkinen

[11] 4,373,564

[45] Feb. 15, 1983

[54] SELF-PROPELLED WOOD PROCESSING APPARATUS

[76] Inventor: Leo L. Heikkinen, Prentice, Wis. 54556

[21] Appl. No.: 206,522

[22] Filed: Nov. 13, 1980

[51] Int. Cl.[3] ..... B27L 7/00

[52] U.S. Cl. ..... 144/366; 144/3 K; 414/491; 414/555

[58] Field of Search ..... 144/193 R, 193 A, 3 K; 414/436, 491, 555

[56] References Cited

U.S. PATENT DOCUMENTS

| | | | |
|---|---|---|---|
| 3,302,808 | 2/1967 | Herpich et al. | 414/491 |
| 4,101,081 | 7/1978 | Ritter et al. | 414/491 |
| 4,103,794 | 8/1978 | Shaw | 414/555 |
| 4,160,470 | 7/1979 | Sigmund | 144/193 A |
| 4,294,295 | 10/1981 | Olin | 144/3 K |

FOREIGN PATENT DOCUMENTS

| | | | |
|---|---|---|---|
| 1028933 | 4/1978 | Canada | 144/3 K |

OTHER PUBLICATIONS

"The Bloomfield Harvester" (Technical Bulletin), Bloomfield Farms, 1978.

*Primary Examiner*—W. D. Bray

*Attorney, Agent, or Firm*—Jacobson and Johnson

[57] ABSTRACT

A self-propelled and steerable wood processing system for converting a log into firewood wherein the wood processing system has a pick-up mechanism that can be advanced into a pile of logs to be cut with the pick-up mechanism rotatably mounted to permit placing a log on a log deck where it can be fed into a cutting and splitting mechanism for forming the log into firewood.

10 Claims, 3 Drawing Figures

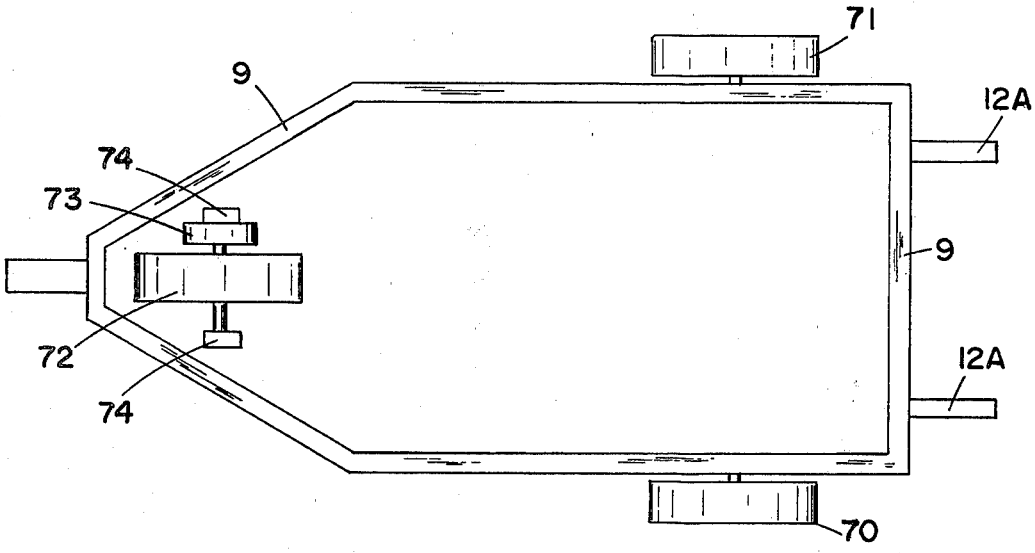
FIG. 2
FIG. 3
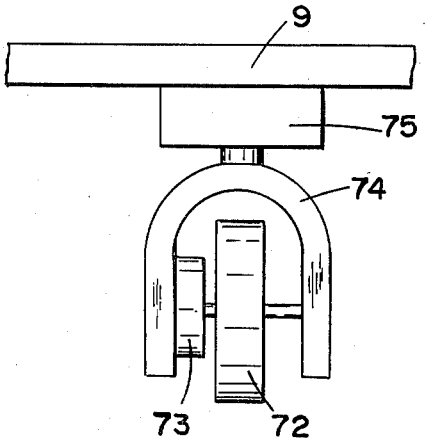

SELF-PROPELLED WOOD PROCESSING APPARATUS

BACKGROUND OF THE INVENTION

1. Field of the Invention

This invention relates generally to a self-propelled and steerable wood processing apparatus for handling, measuring, cutting and splitting logs and, more particularly, to a system that can be easily transported to a site where logs are to be cut into firewood.

2. Description of the Prior Art

Various apparatus for splitting firewood are known in the art. One prior art system is shown in applicant's U.S. Pat. No. 4,173,237. The firewood systems of applicant's patent shown an apparatus for converting a log into firewood which utilizes a remote controlled log carried bed, a log cutter, a log splitter and a log converting system that allows the log to be converted into firewood in one continuous operation. Basically, the apparatus shown in my U.S. Pat. No. 4,173,237 is a stationary unit where the logs are placed on the deck of the wood processing system.

Typical examples of other prior art apparatus are shown in U.S. Pat. Nos. 3,640,323; 3,077,214; 3,422,955; 3,280,864; 3,356,115 and applicant's prior art U.S. Pat. No. 3,862,651. Basically, these prior art apparatus have power actuated rams which either force the cut log into a splitting wedge or force a splitting wedge into a cut log. Thus, the basic concept of splitting a cut log with a power actuated wedge is well known in the art. The prior art inventions also include a saw for cutting the log into proper lengths. The prior art invention shown in applicant's U.S. Pat. No. 3,862,651 comprises a first generation apparatus for advancing, measuring, cutting and splitting logs into fireplace wood. A side mounted lifting mechanism permits one to place a log to be cut into a cutting chamber.

This first generation prior art system generally comprises a bed for supporting and advancing a log into a position to be cut off. The log supporting bed comprises an endless chain which is mounted on sprocket wheels between sides of a V-shaped trough. A saw is located at the end of the bed for cutting the log into preselected lengths. A hydraulic ram is mounted on the apparatus for splitting the log by forcing the log against a splitting wedge to sever the log into firewood. The hydraulic ram also rotates the endless chain and advances the remaining portion of the log into a position where the end of the log can be cut into fireplace lengths.

The invention shown in U.S. Pat. No. 4,173,237 provides a second generation system for large scale processing of logs into firewood whereby the logs are placed onto a bed wherefrom they are subsequently delivered to a log holder which feeds the log into a cutting mechanism. After the log is cut to the proper length and subsequently split into fireplace wood, the split firewood is conveyed into a bin or carrier.

The present invention provides a third generation wood processing system that can more quickly and conveniently perform the wood processing through a self-powered unit that can be advanced into a pile of logs thereby providing for a truly one person wood processing apparatus.

SUMMARY OF THE INVENTION

Briefly, the present invention comprises a self-propelled apparatus having means for picking logs from a pile of uncut logs, a load deck for receiving a pile of uncut logs, means on the deck for advancing a log into position where the log can be properly positioned for transfer to a log holder that grasps the log in a pinching action. The log is advanced into the path of a cutting mechanism which cuts off the end of the log into firewood lengths. After the cutting mechanism cuts off the end of the log, the end of the log falls into a diverter. The diverter allows an operator to reject the end of logs which are not suitable for splitting. The end of logs which are suitable for splitting are fed into a retractable splitting station where a hydraulic ram forces the log into a splitting wedge. The splitting wedge can be positioned vertically to enable the operator to insure the log is split into proper size firewood.

The splitting wedge which extends beyond the side of the wood processing apparatus is retractable to permit the unit to be transported over public roads.

BRIEF DESCRIPTION OF THE DRAWING

FIG. 2 is a bottom view of my invention; and

FIG. 3 is a rear view of the self propelling and steering mechanism for my wood processing system.

DESCRIPTION OF THE PREFERRED EMBODIMENT

Figure 1:
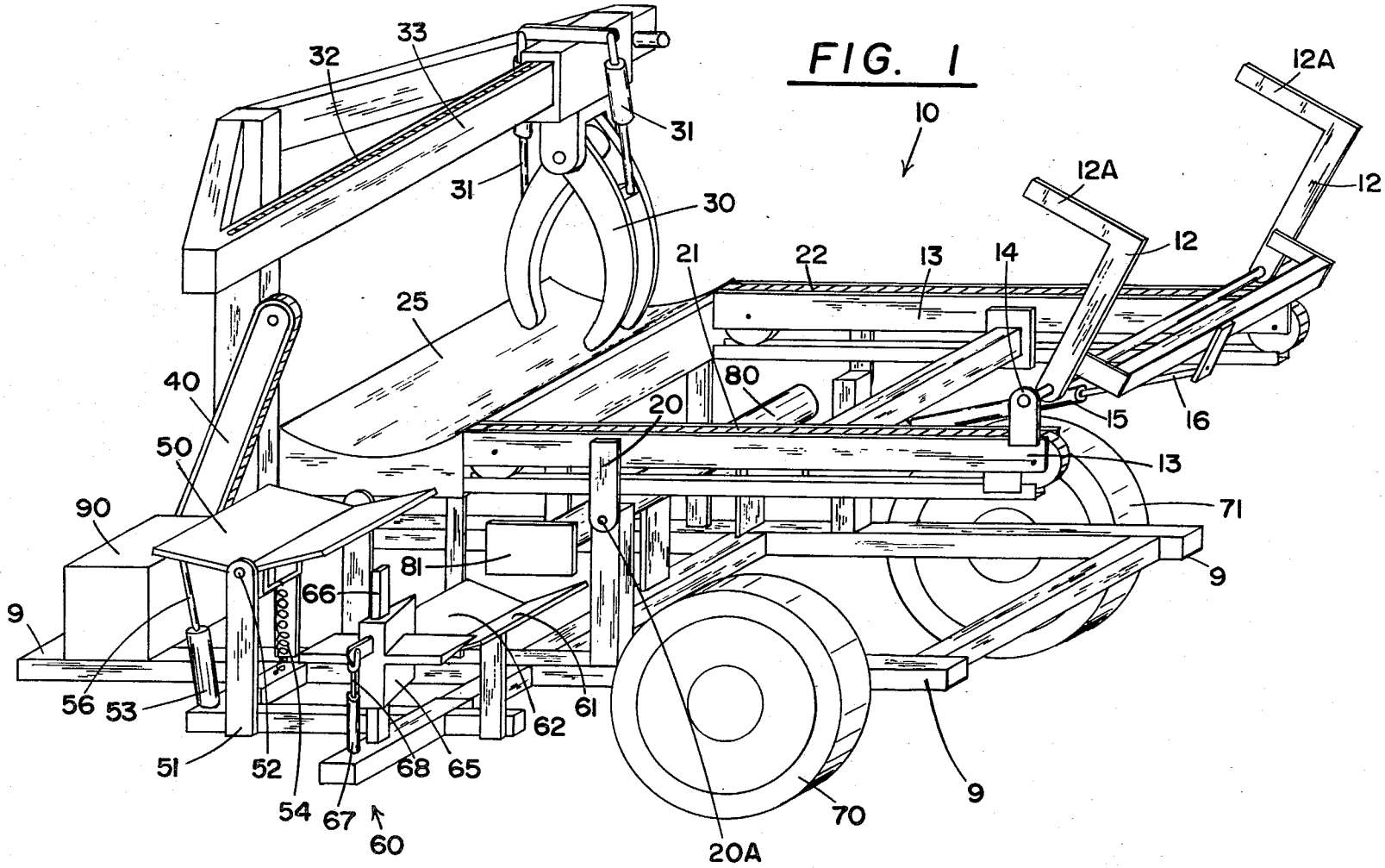
FIG. 1 is a perspective view of my self-propelled wood processing system.

Referring to FIG. 1, reference numeral 10 generally designates the self-propelled system for converting logs into firewood. By firewood it is meant logs that have been cut and split for use in a stove or fireplace. System 10 comprises a pair of L-shaped arms 12 that are pivotally mounted to log deck 13 through members 14, a hydraulic cylinder 15 with an extendable ram 16 permits an operator to rotate arms downward so arms 12A are parallel to the ground. It should be understood that the present unit utilizes a conventional engine (not shown) to produce hydraulic pressure for use in operation of the equipment. As hydraulic generating equipment is well known it will not be shown or described herein.

Log deck 13 is pivotally mounted to the system 10 through a pair of pivot members 20 and 20A located on each side of log deck 13 only one of which is shown in FIG. 1. Deck 13 can be tilted downward (clockwise) through a hydraulic cylinder and ram (not shown) to permit an operator to place arms 12A on the ground. In this position the operator can advance the entire processing system forward and into the pile of uncut logs through the hydraulic motor and hydraulic controls that power rear wheel 72. By rotating arms 12 counterclockwise the uncut logs can be placed on log deck 13. Log deck 13 has a hydraulic powered feed mechanism that drives a pair of endless rotatable chains 21 and 22 that carry the logs to a curved log support surface 25. A laterally positionable log tongs 30 permits the operator to firmly grasp a log. Log holder 30 permits an operator to feed a log into a cutting mechanism 40 where the log is cut to a length suitable for a fireplace or heating stove. The end of the cut log falls into a V-shaped diverter 50. An operator through remote hydraulic controls (not shown) can tilt diverter 50 to direct the end of the logs into a retractable splitting mechanism 60 which splits the logs into firewood or into a log pile which does not require splitting.

In order to understand the details and features of the present invention, reference should be made to FIG. 1 in conjunction with FIG. 2 and FIG. 3. FIG. 2 shows a bottom view of frame 9 of system 10 and the self-propelled features of system 10 and FIG. 3 shows the rear powered wheel 72.

In operation of system 10 the operator positions log cutting apparatus 10 in front of a pile of uncut logs through the self-propelling mechanism of the system. Located on each side of the lower frame 9 self-propelled system 10 are a pair of wheels 70 and 71. Located at the rear of my invention is a powered wheel 72 which can be rotated about a vertical axis through a hydraulic steering mechanism 75. Located on the side of wheel 72 is a hydraulic motor 73 that connects to wheel 72 to propel wheel 72 in either a forward or reverse direction. A yoke 74 forms the rotatable connection between frame 9 and wheel 72. The steering mechanism permits the operator to turn the entire system 10 as it is moved forward or backward. The coaction of L-shaped log pick-up arms 12 and the propelling mechanism will now be described.

First, the operator drives the self-propelled wood processing system 10 to a position proximate a pile of uncut logs by activating hydraulic motor 73. Next, the operator tilts log deck 13 downward while also rotating arms 12 clockwise until members 12A are parallel to the ground. Log deck 13 is lowered until arms 12A are resting on the ground immediately in front of the pile of uncut logs. Next, the operator drives the entire wood processing system 10 forward by powering rear wheel 72 thus forcing arms 12A under the pile of logs to be cut. After placing arms 12A under the logs, the operator rotates arms 12 counterclockwise to deposit the logs on log deck 13. Log deck 13 can then be tilted counterclockwise until it is level (FIG. 1). In this position a log can be directed on endless chains 21 and 22 onto curved log support surface 25. Endless chains 21 and 22 are controlled remotely by the operator through a hydraulic mechanism (not shown).

As the uncut log approaches tongs 30 the operator opens tongs 30 though remote controlled hydraulic cylinders 31. Once the log is positioned on log support surface 25, the operator closes tongs 30 around the log. Through a hydraulic motor (not shown) and a chain 32 the operator can advance tongs 30 laterally along cross member 33. The operator advances the log laterally until the log is in the proper position for cutting. Next, through additional hydraulic controls, the operator remotely activates a cutting mechanism such as pivotally mounted chain saw 40 which pivots clockwise cutting off the portion of log projecting outward from log support surface 25. While a chain saw is shown, it is apparent that a circular cut off saw would also perform as well. The cut log falls into a diverter plate 50 which is pivotally mounted to frame member 51 through a shaft 52. A spring member 54 holds diverter plate 50 in a normally upward facing manner. In order to divert a log into the proper position, i.e., to the right or left, a hydraulic member 53 is provided which has a rod which can be either retracted or extended. If rod 56 is extended, the cut log is directed to the right and into splitting mechanism 60. When member 56 is contracted, the cut log is diverted to the left and into a nonsplitting pile.

When the cut log is diverted into retractable splitting mechanism 60, the log can be split to proper size. The retractable splitting mechanism 60 comprises a first log support plate 61 and a second log support plate 62. Located at the end of log support plate 61 and 62 is a splitting wedge 65; splitting wedge 65 is slidably mounted and vertically positionable on arm 66 through a remote controllable hydraulic cylinder 67 having an extendable rod 68. That is, splitting wedge 65 can be raised or lowered by extension or contraction of hydraulic member 67. This allows proper positioning of splitting wedge 65 with respect to the cut log. Located in front of splitting wedge 65 is a hydraulic cylinder 80 which is connected to a push plate 81 that can be extended outward toward splitting wedge 65. Typically, cylinder 80 forces a log which is supported by plates 61 and 62 into splitting wedge 65.

Retractable splitting mechanism 60 has a base member which telescopes inward on each other at locations denoted by reference numeral 69. In the retracted position the entire width of the mechanism is such to permit easy transportion over roads.

For purposes of clarity, the hydraulic connection lines and operator controls for the hydraulic unit have not been shown; however, the hydraulic lines and hydraulic motors are known in the art.

I claim:

1. A self-propelled apparatus for converting a log into firewood comprising:
   - a pick-up member for lifting a plurality of logs onto a log deck;
   - a tiltable log deck for receiving a plurality of logs and for coacting with said pick-up member;
   - means for delivering a log from said log deck to a log feeder;
   - a log feeder having means for grasping and securely holding a log;
   - means for cutting the log into fireplace wood when said log is held by said log feeder;
   - means for diverting the cut logs to a splitting mechanism;
   - a splitting mechanism for splitting the cut logs into fireplace wood; and
   - means for propelling the apparatus to permit an operator to pick logs from a pile with said pick-up member and then transfer the logs to said log deck.

2. The invention of claim 1 including a retractable splitting mechanism to permit the unit to be easily transported.

3. The invention of claim 2 wherein said pick-up member includes rotatable arms for lifting a log and placing a log on said log deck.

4. The invention of claim 2 wherein said means for grasping said log includes a pincher tongs that coacts to firmly hold a log therein.

5. The invention of claim 4 wherein said log feeder includes means for intermittently advancing a log held in the pincher tongs into a cutting mechanism.

6. The invention of claim 2 wherein said means for cutting a log comprises a chain saw.

7. The invention of claim 2 wherein said apparatus includes at least one steerable wheel for controlling the direction of advancement of said apparatus.

8. The invention of claim 1 wherein said splitting mechanism is retractable to decrease the width of said self-propelled apparatus to permit easy transportation over roads.

9. The method of converting a pipe of uncut logs into firewood comprising the steps of:
   - advancing a wood processing apparatus into a pile of wood to be cut into firewood;

elevating the wood to be cut into firewood onto a log deck;

moving the wood to be cut into a position for cutting the wood; and transporting the cut wood into a mechanism for splitting the wood into firewood.

10. A system for converting a log into firewood comprising:

a pick-up member for lifting a plurality of logs onto a log deck;

a log deck for coacting with said pick-up member, said pick-up member operable to advance into a pile of uncut logs to pick up an uncut log and deliver it to said log deck;

means for delivering a log from said log deck to a log feeder;

a log feeder having means for grasping and securely holding a log;

means for cutting the log when said log is held by said log feeder;

means for diverting the cut logs to a splitting mechanism; and a splitting mechanism for splitting the cut logs into fireplace wood, said splitting mechanism including a splitting wedge slidably mounted and remotely positionable to permit proper positioning of said splitting wedge with respect to a cut log.

* * * * *